United States Patent [19]

Majthan et al.

[11] Patent Number: 4,514,618

[45] Date of Patent: Apr. 30, 1985

[54] COMPACT ELECTRIC HAIR DRYER

[75] Inventors: Rudolf Majthan, Schwalbach; Rolf Stühler, Wi-Delkenheim, both of Fed. Rep. of Germany; Raymond G. Parsonage, Maidenhead; Charles C. Packham, Wockingham, both of England

[73] Assignee: Braun AG, Kronberg, Fed. Rep. of Germany

[21] Appl. No.: 576,772

[22] Filed: Feb. 3, 1984

Related U.S. Application Data

[62] Division of Ser. No. 281,624, Jul. 9, 1981, abandoned, which is a division of Ser. No. 133,740, Mar. 25, 1980, Pat. No. 4,300,280.

[51] Int. Cl.[3] ..... H05B 3/02; A45D 20/08

[52] U.S. Cl. ..... 219/370; 34/97; 219/373; 219/375

[58] Field of Search ..... 219/369, 370, 371, 373, 219/374–376, 381, 382, 379, 380; 34/96–101, 243 R; 132/9, 11 R; 29/611

[56] References Cited

U.S. PATENT DOCUMENTS

| | | | |
|---|---|---|---|
| 1,866,840 | 7/1932 | Carmean | 219/371 |
| 2,429,733 | 10/1947 | Trent | 219/369 |
| 3,383,700 | 5/1968 | Taylor | 34/99 |
| 4,300,280 | 11/1981 | Majtham et al. | 29/611 |
| 4,308,670 | 1/1982 | Bonnema | 219/370 X |

FOREIGN PATENT DOCUMENTS

| | | | |
|---|---|---|---|
| 0008478 | 3/1980 | European Pat. Off. | 219/370 |
| 662078 | 7/1938 | Fed. Rep. of Germany | 219/370 |
| 816005 | 10/1951 | Fed. Rep. of Germany | 219/375 |
| 856927 | 11/1952 | Fed. Rep. of Germany . | |
| 1557256 | 4/1970 | Fed. Rep. of Germany . | |
| 1628221 | 6/1971 | Fed. Rep. of Germany . | |
| 2307066 | 8/1974 | Fed. Rep. of Germany . | |
| 2843366 | 4/1979 | Fed. Rep. of Germany | 219/375 |
| 2815902 | 10/1979 | Fed. Rep. of Germany | 219/370 |
| 923064 | 10/1947 | France . | |
| 1287870 | 2/1962 | France . | |
| 2206919 | 6/1974 | France . | |
| 2214870 | 8/1974 | France . | |
| 2409655 | 6/1979 | France . | |
| 1525179 | 9/1978 | United Kingdom . | |
| 1558268 | 12/1979 | United Kingdom | 219/375 |

*Primary Examiner*—A. Bartis

*Attorney, Agent, or Firm*—Sughrue, Mion, Zinn, Macpeak and Seas

[57] ABSTRACT

An axially compact hairdryer includes a cylindrical housing having an air inlet and an air outlet at opposite ends thereof. An electric motor is centrally mounted within the housing by a pair of spaced apart support grates secured to the housing perpendicular to the air flow and a cylindrical heating element support body is carried by the support grates and located in concentric spaced relation between the housing and the motor. The heating element is wound about the support element. A fan is operatively connected to the motor for moving air from the inlet to the outlet over the heating element. Air directing vanes are attached to one of the support grates between the motor and the fan.

3 Claims, 3 Drawing Figures

COMPACT ELECTRIC HAIR DRYER

The present application is a division of application Ser. No. 281,624, filed July 9, 1981, now abandoned, which in turn is a division of application Ser. No. 133,740, filed Mar. 25, 1980, now U.S. Pat. No. 4,300,280, granted Nov. 7, 1981.

BACKGROUND OF THE INVENTION

The invention relates to a hair dryer with a fan driven by an electric motor and an electric heating element and more specifically to the means for supporting the motor and heating element in the housing of the hair dryer.

Hair dryers of the type mentioned above have been in general use for many years. Such hair dryers should be made as light and compact as possible so as to make them comfortable to use. The small dimensions are necessary, because hair dryers are often taken along on trips and should then take up as little luggage space as possible.

Customary hair dryers have their electric heating elements behind the fan and in front of the air outlet. This necessitates considerable distance between the fan and the end of the air outlet to accommodate the heating element and to give the air stream sufficient time to circulate intensively to eliminate air streams of widely varying temperatures.

Providing electric heating of the fan blades has already been suggested. Such a fan would require no more space in the hair dryer than is required by the fan itself. The air passes rapidly over the fan blades. The heat transfer is very good so that the heating surface can be small and the heating temperature can be low. The heated air is well mixed by the fan and subsequently in the outlet so that no temperature streams arise. The disadvantage associated with this suggestion lies in the fact that the use of such a specialized fan makes the hair dryer expensive.

SUMMARY OF THE INVENTION

The object of the invention is to produce a hair dryer which is as compact and light as possible, has uniform air temperature and is economical to produce.

The first object mentioned above is achieved according to the invention by locating the electric heating element around the outside of the electric motor.

In hair dryers having axial air passages, the fan determines the diameter of the housing, based on the necessary fan output. Behind the fan, between the motor and the housing, there is an annular space, which has remained unused up to now. The invention uses this annular space to accommodate the electric heating element. Thus, the hair dryer in the invention can be built very compact. Since the air moves rapidly through this annular space, good heat transfer from the heating element to the air is possible. This allows the electric heating element to operate under high surface area load. The high air speed also prevents the hair dryer housing, which is normally made of plastic, from overheating.

It is desirable to make the support body for the heating element out of a material with as low a heat retention capacity as possible. Practice has shown that when the material known as Mekanite is used, the heat retention capacity of the heating element is so low that the fan moves enough air over the heating element after the hair dryer is switched off to cool the heating element sufficiently to prevent overheating of the housing. Mekanite is a micaceous material with a silicon binder.

Preferably, the electric heating element has a hollow cylindrical support body.

The heating wire or the heating coil extends into the flow section between the electric motor and the housing and thereby facilitates efficient heat transfer.

The electric heating element is held between two support grates which are secured inside the hair dryer housing.

A separate outlet grate can be spared if the support grate on the air outlet side also serves as the outlet grate. A particularly efficient yet economical model can be constructed if the heating element is as long as the electric motor and if both support grates serve as mounts for the heating element and the electric motor.

Air directing vanes are provided between the fan and the electric heating elements to provide a particularly uniform axial flow of air in the annular space between the electric motor and the housing. This assures very uniform temperature distribution in the air emitted by the hair dryer.

It is advantageous for the air directing vanes to be attached to the support grate on the inlet side of the electric heating element.

Because the heating element is disposed around the electric motor, only short distances from the heating body must be bridged to provide current to the electric motor. It is thus possible to supply current to the motor by means of a contact strip directly attached to the wrapping of the electric heating element.

Another feature provides for a lead plate with an integral circuit breaker switch for the electric heating element. The lead plate is situated in the handle of the housing and corresponds roughly to the shape of the inside of the housing. This places the circuit breaker switch at a safe distance from the heating element, whereby the housing is effectively protected and any unnecessarily premature breaking of the circuit is also avoided.

The support body is most advantageously constructed as a flat strip of material which is bent into a cylinder after being wrapped with heating wire as wrapping is done mechanically much easier on the flat strip of material than on a closed cylinder.

The support body is held together by two attachment rivets, which, on the one hand, hold together the two ends of the material shaped into a cylinder, and, on the other hand secure the heating wire and the lead wires together. Thus the attachment rivets have a double function, serving as fastening elements for the support body bent out of a strip of material, and as attachment clamps for the electric leads.

Preferably, the attachment rivets have two V-shaped arms angled away from the support body. The heating wires and the lead wires can be attached to respective arms.

To achieve the necessary flexibility in the flat strip of material used to form the cylindrical support body, it is advantageous to bend the flat strip of material between two rollers before finally bending it into a cylinder, and then to flatten it out again to wind the heating wire thereon. Practice has shown that the preferred material Mekanite is too rigid to be formed into the desired cylindrical shape without such prior bending.

The procedure according to the invention for producing a cylindrical, electric heating element for hair dryers is characterized by the following steps:

(a) bending a flat strip of Mekanite material between two rollers, (b) flattening the bent strip of material again, (c) transversely wrapping the strip of material with a heating wire, and (d) bending the strip of material with the heating wire wrapping into a cylinder.

This process makes the brittle strip material sufficiently flexible so that after being wrapped with heating wire it can be given the desired cylindrical form. This bending is simplified if at least one of the two rollers is longitudinally fluted. This fluting forms slight waves in the strip of material, thus making it easier to bend it to the predetermined shape. Highly uniform bending during the formation of the cylindrical support body can be achieved by placing the strip of material between two thin metal sheets and bending it with a roller.

DETAILED DESCRIPTION OF THE PREFERRED EMBODIMENTS

Figure 1:
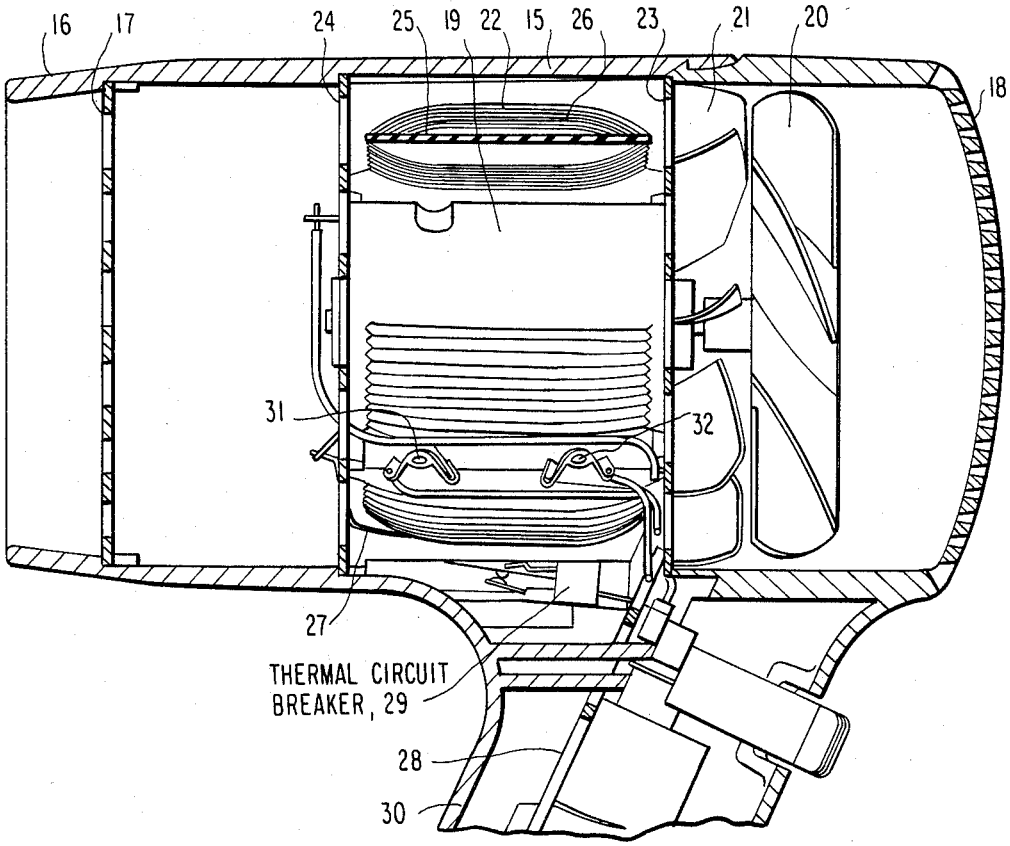
FIG. 1 is a longitudinal section through a hair dryer constructed according to the invention.

FIG. 1 shows a hair dryer having a housing 15 with an air outlet 16. An air outlet grate 17 is situated in front of the outlet 16 inside the housing, which prevents the user from reaching into the housing. On the opposite end of the housing, an air inlet grate 18 is provided, through which ambient air enters the hair dryer. An electric motor 19 is supported by support grates 23 and 24 inside the housing 15 and drives a fan 20. Air directing vanes 21 are attached to support grate 23 between the fan 20 and the electric motor 19. The air blown by the fan 20 is directed by the vanes 21 so that it flows axially through the annular space between the electric motor 19 and the housing 15. An electric heating element 22 is located in this annular space and is supported by two support grates 23, 24. The support body 25 for the heating element 22 is a hollow cylinder, around which the heating wire 26 is wound. The heating wire 26 in the depicted embodiment is wound according to German OS No. 25 30 075.

FIG. 1 also shows a contact strip 27 which is connected to the heating wire 26 and also leads directly to the electric motor 19. This feature is more clearly visible in FIG. 3.

FIG. 1 also shows a circuit breaker switch 29 mounted on a lead plate 28 in the handle 30 of the hair dryer. This circuit breaker switch 29 serves to cut off the current if the heating element 22 should overheat. It is located inside the housing 15 at the place where overheating damage is most likely to occur.

Figure 2:
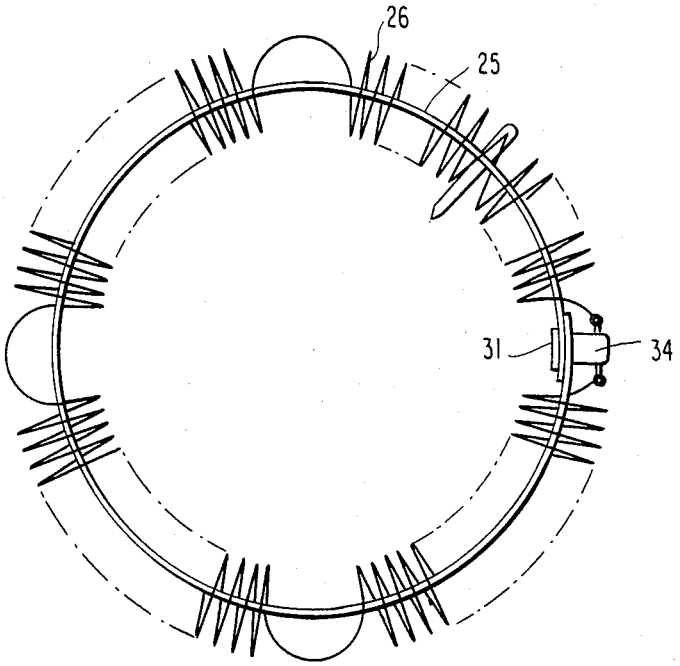
FIG. 2 is an end view of the heating element of the hair dryer.
Figure 3:
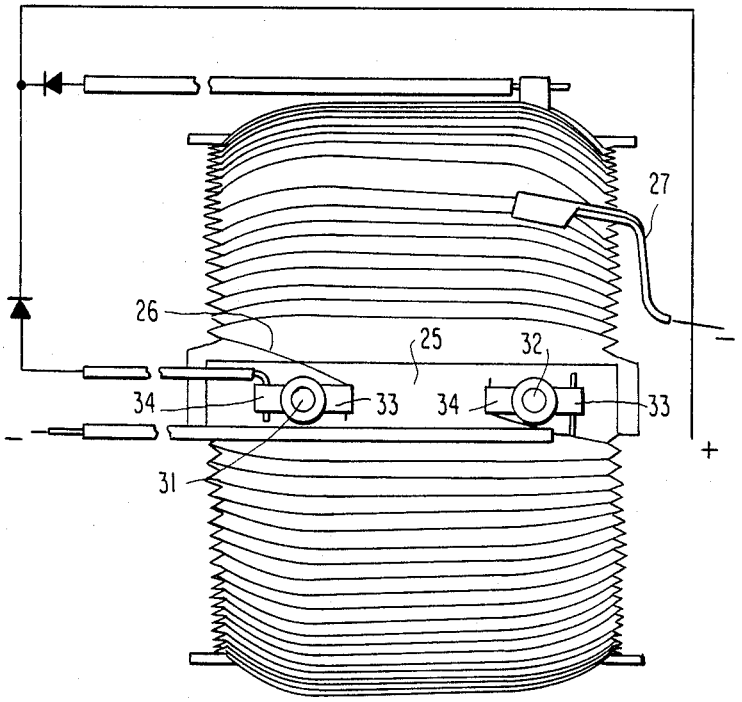
FIG. 3 is a top view of the heating element of the hair dryer according to FIG. 1.

As shown in FIGS. 2 and 3, the support body 25 is bent from a strip of material held in cylindrical shape by two connecting rivets 31, 32. These rivets not only hold the support body together, they also securely hold the heating wire 26 and the lead wire for the heating element. The rivets 31 and 32 each have a pair of V-shaped arms 33 and 34 to which the heater vanes and the lead wires are connected.

What is claimed is:

1. A hairdryer comprising a hollow, elongated housing having air inlet and air outlet means located in opposite ends of said housing, a pair of spaced apart grates secured in said housing perpendicular to the direction of air flow from said air inlet means to said air outlet means, an electric motor extending lengthwise of said housing and supported at opposite ends by said grates in spaced relation to the housing to form annular air flow space between the motor and the housing around the entire motor, a fan wheel driven by said electric motor and disposed intermediate said motor and said air inlet means for creating a flow of air from said air inlet means through said air flow space around the motor and out said air outlet means, a hollow cylindrical body supported at opposite ends by said grates and disposed co-axially about said motor and an electric heating element wound about said cylindrical body and positioned in said air flow space to heat the air flowing therethrough from said air inlet means to said air outlet means.

2. A hairdryer as set forth in claim 1 further comprising air directing vanes carried by one of said support grates intermediate said one of said support grates and said fan.

3. A hairdryer as set forth in claim 1 wherein said cylindrical support body is comprised of a rectangular strip of material bent into a cylinder with overlapping ends thereof held together by securing means and wherein said heating element is wound about said support body perpendicular to the end edges of said cylindrical body.

* * * * *